United States Patent [19]

Montgomery

[11] 4,284,024

[45] Aug. 18, 1981

[54] MULTI-HULL BOAT

[76] Inventor: Jon A. Montgomery, 84 Broom Park, Teddington, Middlesex, England

[21] Appl. No.: 47,069

[22] Filed: Jun. 11, 1979

[51] Int. Cl.[3] ..... B63B 1/00

[52] U.S. Cl. ..... 114/61; 114/39; 114/56; 9/2 A; 9/6.5

[58] Field of Search ..... 114/39, 61, 56; 9/2 A, 9/6 R, 6.5, 11 A

[56] References Cited

U.S. PATENT DOCUMENTS

| | | | |
|---|---|---|---|
| 3,473,502 | 10/1969 | Wittkamp | 114/61 |
| 3,656,445 | 4/1972 | Padwick | 114/39 |
| 3,841,251 | 10/1974 | Larson | 114/61 |
| 4,046,091 | 9/1977 | Lomas et al. | 114/39 |
| 4,100,870 | 7/1978 | Prade | 114/39 |
| 4,102,287 | 7/1978 | Ferris | 114/39 |
| 4,136,414 | 1/1979 | Popkin | 114/61 |

FOREIGN PATENT DOCUMENTS

| | | | |
|---|---|---|---|
| 1290446 | 3/1969 | Fed. Rep. of Germany | 9/2 A |
| 261533 | 5/1949 | Switzerland | 9/2 A |

*Primary Examiner*—Trygve M. Blix
*Assistant Examiner*—D. W. Keen
*Attorney, Agent, or Firm*—Blanchard, Flynn, Thiel, Boutell & Tanis

[57] ABSTRACT

A catamaran comprises a pair of inflatable tubular hulls. A longitudinal beam is secured to the top of each hull and extends along the whole length thereof. A pair of spaced cross beams are rigidly secured to the longitudinal beams. A mast may be stepped on the front cross beam and stayed to the longitudinal beams.

11 Claims, 4 Drawing Figures

MULTI-HULL BOAT

The present invention relates to multi-hulled boats of the kind comprising a pair of inflatable hulls.

According to the present invention there is provided a boat comprising a pair of inflatable hulls, a pair of torsionally stiff longitudinal beams, each beam being attached or attachable to the top of a respective hull and extending substantially the whole length of the hull when the latter is inflated, and a pair of cross beams for interconnecting the longitudinal beams at spaced positions along the lengths of the longitudinal beams and means for securing the cross beams to the longitudinal beams against torques generated in the longitudinal beams.

Advantageously, the forward cross beam is located in a suitable position for a mast to be stepped on it to form a sailing boat. Fore-stays for the mast can then be anchored to the forward ends of the longitudinal beams.

In a preferred arrangement, the inflatable part of each hull tapers down towards a point at the bow end of the hull and thus has a bow portion which is spaced below the general axis of the longitudinal beam and means are provided for spacing the said bow end of the inflatable portion of the hull a fixed predetermined distance below the axis of the beam. Conveniently, these means comprise a stiff bow stem fixed to the bow end of the inflatable hull portion and to the forward end of the longitudinal beam. Such a bow stem may have the shape and dimensions which would be used for a rigid hull of a similar boat.

A rudder may be pivotally mounted at the aft end of each of the longitudinal beams, the tillers of the two rudders being interconnected by a tie rod. A pair of dagger-boards can be mounted for vertical sliding movement in dagger boxes, one adjacent each hole, the dagger boxes being supported by two further cross beams anchored to the longitudinal beams.

A trampoline deck can be secured to the longitudinal and cross beams and tightened by suitable lacing. The longitudinal beams can be secured to their respective inflatable hull portions again by suitable lacing.

An embodiment of the invention will now be described by way of example with reference to the accompanying drawings, in which.

Figure 1:
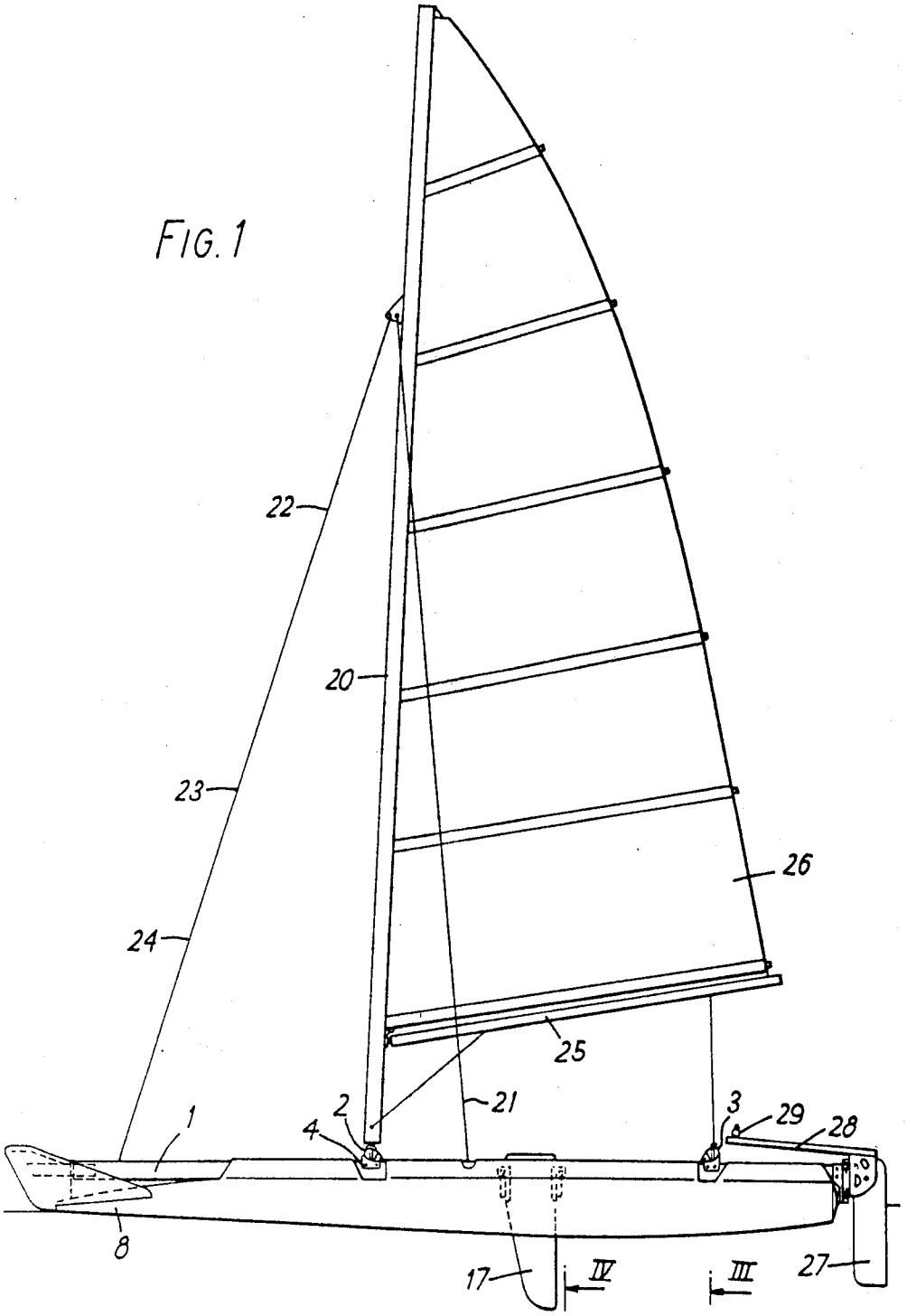
FIG. 1 is an elevational view of a catamaran having inflatable hulls.
Figure 2:
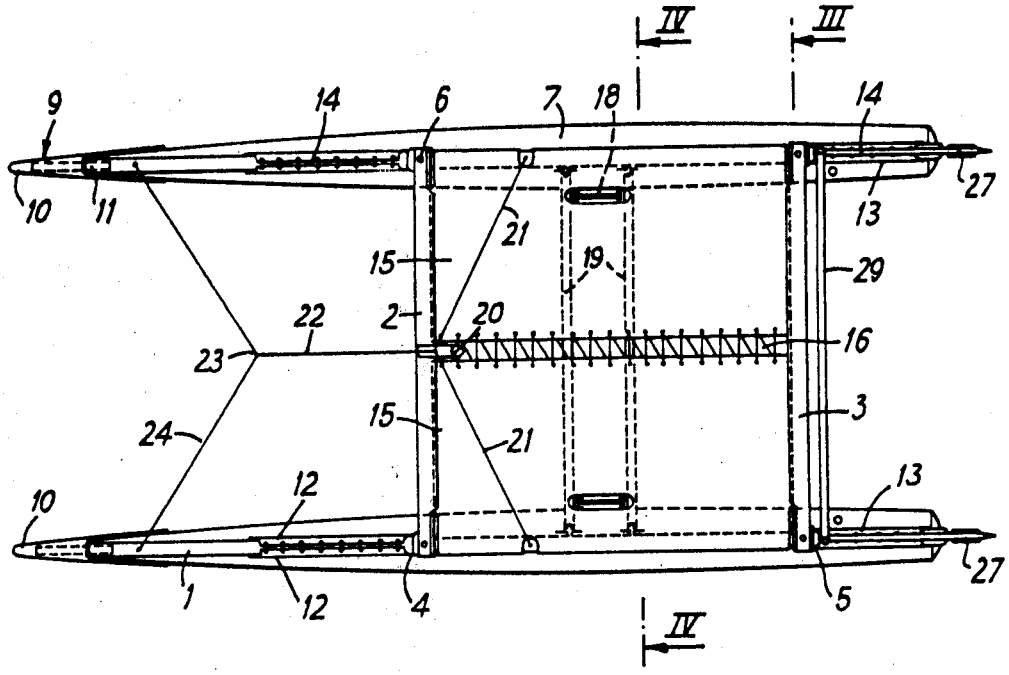
FIG. 2 is a plan view of the catamaran shown in FIG. 1.
Figure 3:
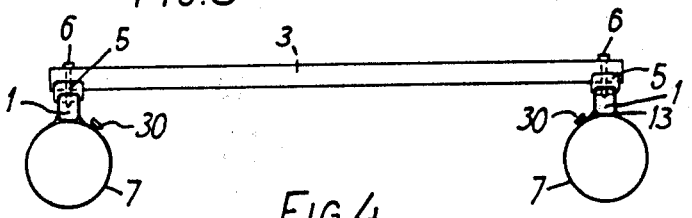
FIGS. 3 and 4 are cross sectional views respectively on the lines III—III and IV—IV of FIGS. 1 and 2.
Figure 4:
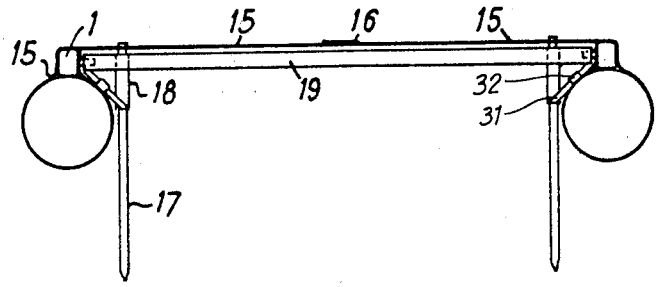

The catamaran shown in the drawings has a tubular aluminum frame comprising two longitudinal tubular beams 1 interconnected by two tubular cross beams 2 and 3 which have their ends held securely in saddle castings 4 and 5 on the longitudinal beams 1 by through bolts 6. The saddle castings 4 and 5 may be secured to the longitudinal beams 1 by adhesive bonding and riveting. The ends of the cross beams 2 and 3 preferably contained inserts to prevent the ends of the tubular beams 2 and 3 collapsing under the tension of the bolts 6.

Each longitudinal beam 1 is secured to the top surface of an inflatable hull 7 which is of greatest cross section in the region between the two cross beams 2 and 3 and tapers down to a smaller cross section both at the aft end and at the elongated forward end of each hull which is accordingly spaced from the forward end of the longitudinal beam 1. The inflatable hull 7 may for example be made of a rubberised fabric or PVC.

Bonded to the forward end 8 of each hull is a bow stem 9 which can be made of plywood or fibre reinforced plastics material and which presents a stiff bow forming portion 10 carrying two lateral wings which extend rearwardly and have some flexibility to conform to the flexibility of the inflatable hull portion. Each bow stem 9 carries a rearwardly extending spigot 11 which engages in the forward end of its longitudinal beam 1. Each inflatable hull 7 is secured to its longitudinal beam 1 by means of pairs of flaps 12 and 13 respectively forwards of the cross beam 2 and aft of the cross beam 3, the flaps being bonded to the hull and tightened around the longitudinal beam 1 by means of lacing 14. In the part between the two cross beams 2 and 3, each inflatable hull 7 has bonded to it half of a trampoline deck 15 which, adjacent its outer edge forms a pocket for the longitudinal beam 1. The two half decks 15 are tightly secured together by further lacing 16.

A pair of dagger boards 17 are vertically slideable in "U" section chamber 18 fixed to a pair of square tube cross members 19 the outer ends of which are engaged on spigots fixed to the longitudinal beam 1. The channels 18 are braced to the tubes 19 by diagonal braces 31 which are engaged by straps 32 to assist in keeping the hulls in the correct attitude. Suitable apertures are formed in the trampoline deck portions 15 to permit the passage of the upper ends of the dagger boards 17 upwards.

A jointed mast 20 has its lower end stepped in a suitable seating at the mid-point of the cross beam 2 and is stayed by a pair of lateral stays 21 having their lower ends fixed to the longitudinal beam 1 and a forestay 22 which divides at 23 to form two lower portions 24 secured to the forward ends of the longitudinal beams 1.

A boom 25 and sail 26 are carried by the mast 20 in the usual manner. A pair of rudders 27 are mounted in the normal manner one at the rear end of each of the longitudinal beams 1 and have their tiller arms 28 pivotally interconnected by a link bar 29.

The hulls 7 can be inflated or deflated through conventional valves 30. Dismantling the catamaran involves unstepping the mast and its rigging, undoing the lacing 16, sliding the two half decks 15 from cross beams 2,3 and removing the four bolts 6 which releases cross beams 2,3, and cross members 19 from beams 1. Undoing lacing 14 allows release of beams 1.

The hulls can then be deflated for transport from example in the boot of a car with mast boom and beams on a roof rack.

I claim:

1. A boat comprising a pair of inflatable hulls, a pair of torsionally stiff longitudinal beams, one for each hull, securing means attaching each said longitudinal beam to the top of the respective hull and extending substantially the whole length of the hull when the latter is inflated, a pair of cross beams interconnecting the longitudinal beams at spaced positions along the lengths of the longitudinal beams, means securing the cross beams to the longitudinal beams at said spaced positions against torques generated in the longitudinal beams, each hull being substantially tubular and tapering down towards a tip at the bow end of the hull, said tip being spaced below the longitudinal beam, and a bow stem structure connected to each said tapered hull bow and holding the said hull bow spaced in a fixed position below said longitudinal beam, each said bow stem structure further defining a pair of bow wings diverging from a bow forming portion rearwardly along and above said tapered hull bow.

2. A boat according to claim 1, and including a mast stepped on said forward cross beam.

3. A boat according to claim 2, in which fore-stays for said mast are anchored to the forward ends of the longitudinal beams.

4. A boat according to claim 1, in which said upstanding bow forming portion is stiff, said diverging bow wings being platelike and carried by said bow forming portion and fastened adjacent their bottom edges to the bow end of the inflatable hull, said stiff bow forming portion having a rearwardly extending spigot telescoped with the forward end of the longitudinal beam, said wings spanning and at least partially laterally covering the vertical space separating the hull bow and longitudinal beam.

5. A boat according to claim 1, including a pair of rudders, each rudder being pivotally mounted on the aft end of a respective said longitudinal beam, each said rudder having a tiller, the boat further including a tie rod interconnecting said tillers for linked operation thereof.

6. A boat according to claim 1, and including a pair of dagger-boards respectively mounted for vertical sliding movement in dagger boxes, one adjacent each hull, the dagger boxes being fixed between and supported by two further cross beams having opposite ends fixedly anchored to the longitudinal beams, said dagger boxes being braced to said further cross beams by diagonal braces engaged by straps on the inflatable hulls to assist in keeping the hulls in the correct attitude.

7. A boat according to claim 6, in which each inflatable hull includes flaps located respectively forward of the pair of cross beams and aft of the pair of cross beams, the flaps being fixed to the hull and tightened around said longitudinal beam releasably, a laterally tensioned flexible sheet trampoline deck fixed to the corresponding inflatable hulls adjacent its outer edges, said trampoline deck adjacent its outer edges forming with the corresponding hulls respective pockets opening toward each other and snugly receiving therein the respective longitudinal beams, a said trampoline outer edge and diagonal brace engaging strap being fixed to the corresponding said inflatable hull on opposite sides of said longitudinal beam whereby lateral tensioning of said trampoline and strap can pull oppositely against inboard and outboard rolling of the hull about the axis of the longitudinal beam.

8. A boat comprising a pair of inflatable hulls, a pair of torsionally stiff longitudinal beams, one for each hull, securing means attaching each said longitudinal beam to the top of the respective hull and extending substantially the whole length of the hull when the latter is inflated, a pair of cross beams interconnecting the longitudinal beams at spaced positions along the lengths of the longitudinal beams, means securing the cross beams to the longitudinal beams at said spaced positions against torques generated in the longitudinal beams, said longitudinal beams being secured to their respective inflatable hull portions by lacing means, each inflatable hull including pairs of flaps located respectively forward of the pair of cross beams and aft of the pair of cross beams, the flaps being bonded to the hull on opposite sides of the longitudinal beam and tightened around said longitudinal beam releasably by said lacing means.

9. A boat according to claim 8 including a flexible sheet defining half a trampoline deck and bonded to the corresponding inflatable hull adjacent its outer edge, said half trampoline deck adjacent its outer edge forming a pocket for the longitudinal beam of the corresponding inflatable hull, the two half decks having inner edges lying close adjacent each other and tightly secured together by further lacing.

10. A boat comprising a pair of inflatable hulls, a pair of torsionally stiff longitudinal beams, one for each hull, securing means attaching each said longitudinal beam to the top of the respective hull, the beam extending substantially the whole length of the hull when the latter is inflated, a pair of cross beams interconnecting the longitudinal beams at spaced positions along the lengths of the longitudinal beams and serving to support a trampoline therebetween, means securing the cross beams to the longitudinal beams at said spaced positions against torques generated in the longitudinal beams, said hulls being of circular cross section with the maximum diameter at a station between said cross beams, said hulls continuously tapering from said maximum diameter station while retaining a circular cross section, the diameter of each hull at the stern thereof being equal to its diameter at a further station spaced between the bow and maximum diameter station thereon, said longitudinal beams being straight, said securing means including portions positively holding the top surface of the tapering circular cross section fore and aft portions of the hull snugly up against the bottom of said straight longitudinal beam substantially from the stern to a departure station near the hull bow, wherein, as seen from the side, the portion of each hull extending from the stern to said station near the bow has its top surface maintained substantially linear in profile by said longitudinal beam but has its bottom surface maintained in an exaggerated convexly rounded profile with maximum depth adjacent said maximum diameter station, said hull tapering forwardly beyond said further station to terminate in a pointed tip spaced beneath the front end portion of said longitudinal beam.

11. A boat according to claim 10, with said departure station spaced along the hull between the forward one of said cross beams and said tip, said top surface of said hull extending forwardly from said departure station and diverging downwardly from said longitudinal beam with the length axis thereof substantially parallel to said beam, said beam including a forward extension extending from said departure station at least substantially to the tip of said inflated hull and spaced thereabove, and including a stiff generally upstanding bow stem member connecting the front ends of said beam extension and inflatable hull tip and spacing said inflatable hull tip a fixed predetermined distance below said longitudinal beam extension, said bow stem member having rearwardly diverging side walls extending back along the sides of said hull from said tip toward said departure station and at least partly covering the space between said beam extension and hull tip, said bow stem member having a stiff leading bow edge which sweeps up from said inflatable hull tip to a level spaced above said longitudinal beam so as to provide said hull with an upswept bow.

* * * * *